US010460893B2

(12) United States Patent
Shang et al.

(10) Patent No.: US 10,460,893 B2
(45) Date of Patent: Oct. 29, 2019

(54) EMBEDDED POLE PART FOR MEDIUM OR HIGH VOLTAGE USE, WITH A VACUUM INTERRUPTER WHICH IS EMBEDDED INTO AN INSULATING RESIN

(71) Applicant: ABB Schweiz AG, Baden (CH)

(72) Inventors: Wenkai Shang, Ratingen (DE); Dietmar Gentsch, Ratingen (DE); Petr Neumann, Brno (CZ); Roman Pernica, Brno (CZ)

(73) Assignee: ABB SCHWEIZ AG, Baden (CH)

( * ) Notice: Subject to any disclaimer, the term of this patent is extended or adjusted under 35 U.S.C. 154(b) by 0 days.

(21) Appl. No.: 15/292,163

(22) Filed: Oct. 13, 2016

(65) Prior Publication Data

US 2017/0032912 A1 Feb. 2, 2017

Related U.S. Application Data

(63) Continuation of application No. PCT/EP2014/002264, filed on Aug. 18, 2014.

(30) Foreign Application Priority Data

Apr. 14, 2014 (EP) ..... 14001354

(51) Int. Cl.
*H01H 33/02* (2006.01)
*H01H 33/66* (2006.01)
*H01H 33/662* (2006.01)

(52) U.S. Cl.
CPC ..... *H01H 33/027* (2013.01); *H01H 33/6606* (2013.01); *H01H 33/66207* (2013.01); *H01H 2033/6623* (2013.01)

(58) Field of Classification Search
CPC ..... H01H 33/53; H01H 33/027; H01H 33/66207; H01H 33/6606; H01H 2033/662
See application file for complete search history.

(56) References Cited

U.S. PATENT DOCUMENTS 4,420,661 A * 12/1983 Efinger ..... H02B 13/0354 218/121
4,808,121 A * 2/1989 Smrekar ..... H01R 4/26 439/394
5,585,611 A * 12/1996 Harvey ..... H01H 33/027 218/134
5,698,831 A * 12/1997 Abdelgawad ..... G01R 15/14 218/138
6,888,086 B2 * 5/2005 Daharsh ..... H01C 7/12 218/134

(Continued)

FOREIGN PATENT DOCUMENTS

WO WO 9527297 A1 10/1995
WO WO 9527298 A1 10/1995

*Primary Examiner* — Truc T Nguyen
(74) *Attorney, Agent, or Firm* — Leydig, Voit & Mayer, LTD.

(57) ABSTRACT

An embedded pole part for medium or high voltage use, with a vacuum interrupter which is embedded into an insulating resin, wherein a current and/or voltage sensor with sensor housing is integrated inside the insulating resin. In order to overcome the problems of the art, and to enhance the accuracy of voltage measurement, a metal grid is implemented into the insulating resin, which is arranged between the sensor housing of the current and/or voltage sensor and the outer surface of the insulating resin.

19 Claims, 4 Drawing Sheets

(56) References Cited

U.S. PATENT DOCUMENTS

| | | | | |
|---|---|---|---|---|
| 7,285,743 | B2 * | 10/2007 | Martin | H01H 33/027 218/136 |
| 7,550,960 | B2 | 6/2009 | Barbour et al. | |
| 2001/0048308 | A1 | 12/2001 | Potter et al. | |
| 2002/0180459 | A1 * | 12/2002 | Skendzic | G01R 15/06 324/628 |
| 2004/0061589 | A1 | 4/2004 | Daharsh et al. | |
| 2009/0111319 | A1 * | 4/2009 | Baldwin | H01R 13/5804 439/459 |
| 2012/0098519 | A1 | 4/2012 | Juds et al. | |
| 2013/0092658 | A1 * | 4/2013 | Ache | H01H 33/66207 218/139 |

* cited by examiner

Prior Art

EMBEDDED POLE PART FOR MEDIUM OR HIGH VOLTAGE USE, WITH A VACUUM INTERRUPTER WHICH IS EMBEDDED INTO AN INSULATING RESIN

CROSS-REFERENCE TO RELATED APPLICATIONS

This application is a bypass continuation application of International Application No. PCT/EP2014/002264, filed on Aug. 18, 2014, claiming benefit to European Patent Application No. 14 001 354.1, filed on Apr. 14, 2014, the entire disclosure of each of which is hereby incorporated by reference herein. The international application was published in English on Oct. 22, 2015, as WO 2015/158357 A1 under PCT Article 21(2).

FIELD

The invention relates to an embedded pole part for medium or high voltage use, with a vacuum interrupter.

BACKGROUND

Concerning state of the art is known from the WO 95/27297, WO 95/27298, and U.S. Pat. No. 7,550,960 B2, where current and voltage sensor are integrated with embedded pole at line and load side.

With the known construction, the external surface of the coil is covered with semiconducting layer, which works as shielding for the internal coil at the same time works as the electrode of capacitive voltage sensor to high voltage primary, the problem is, that the voltage measurement accuracy of integrated current and/or voltage sensors will change with changing insulating resin surface conditions, for example as effected by external humidity, and the parasitic capacitance could change. This parasitic capacitance will also change the capacitance for measurement. Therefore the change of the measurement is shown in FIG. 3-4 as state of the art. The measurement capacitance C1 could have four components, C11 between the inner coil surface to primary conductor with high voltage (HV), left and right coil surface to primary conductor capacitance C12 and C13, and from the external surface C14 to primary conductor.

SUMMARY

An aspect of the invention provides an embedded pole part for medium or high voltage use, the part comprising: a vacuum interrupter which is embedded into an insulating resin, wherein a current and/or voltage sensor including a sensor housing is integrated inside the insulating resin, wherein a metal grid is implemented into the insulating resin, wherein the metal grid is arranged between the sensor housing of the current and/or voltage sensor and an outer surface of the insulating resin.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

An aspect of the invention relates to an embedded pole part for medium or high voltage use, with a vacuum interrupter which is embedded into an insulating resin, wherein a current and/or voltage sensor is integrated inside the insulating resin So an object of the invention is to overcome the aforesaid resulting problems discussed in the Background, and to enhance the accuracy of voltage measurement.

The aforesaid problem is solved in the sense of an object of the invention, in that a metal grid is implemented, preferably completely implemented into the insulating resin, which is arranged between the sensor housing of the current and/or voltage sensor and the outer surface of the insulating resin.

In new situation the insulating resin surface has very high resistance and these four capacitances C1 will be a sum (=C11+C12+C13+C14) for the voltage reading. In the worse case, the external surface is conducting for example due to high humility effects, so the capacitance C1 will change, because C11, C12, and C13 will be more or less the same, the C14 will increase a lot, which depends on the dimension of the construction therefore the change of the reading ratio (=C1/(C1+C2)). Here the capacitance C2 is constant.

Figure 2:
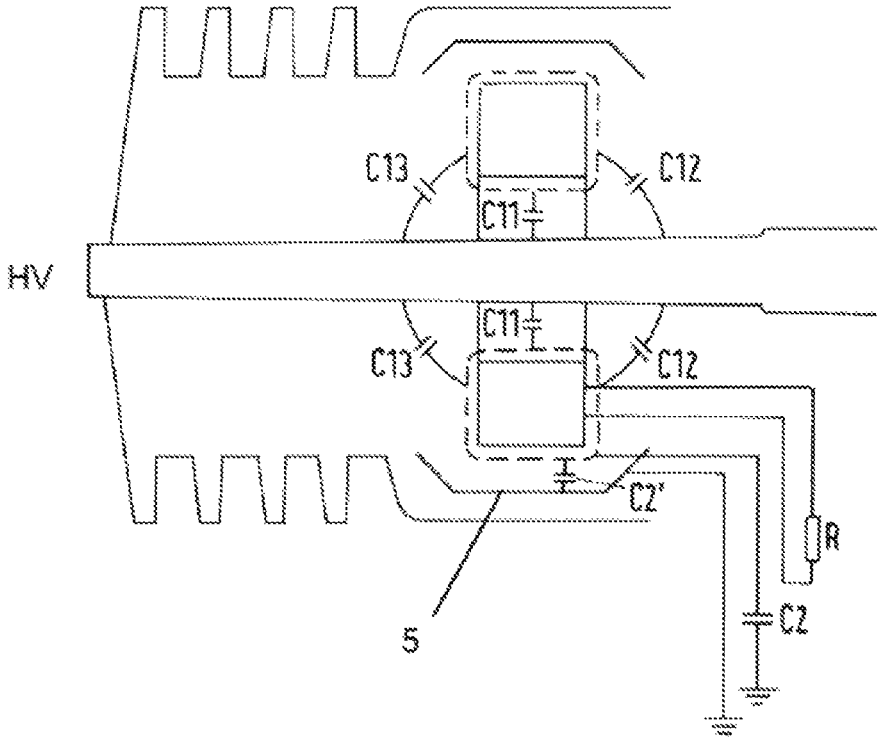
FIG. 2 virtual capacitances as described herein, clarifying the function of certain embodiments of the invention.

By using this grounded metal grid, the measurement capacitance is better defined and the value will not change with external environments. In the new situation realized by the invention, the measurement capacitance is the sum of C11, C12, and C13. The capacitance of an external surface of a coil to the grounded metal grid is also constant and no more component for capacitance C1 instead as component of capacitance C2. The form and dimension is designed in such a way that the parasitic capacitance from the measuring capacitance electrode to the external surface of insulation resin is minimized and limited as shown in FIG. 2.

In an advantageous embodiment the metal grid is electrically conductive or capacitively connected to ground potential.

A further advantageous embodiment is that the metal grid is arranged around the sensor housing but completely inside the resin, as separated steps in production, which is highly advantageous.

In a further advantageous embodiment, the metal grid is connected to ground potential via an electrical conductive wire, which is aligned along its path from the metal grid to the ground potential around the shielded signal cables of the current and/or the voltage sensor in a spiral way. This conductive wire is electrically connected to the shielding of the shielded signal cable and will be grounded or led to the main ground electrically or capacitively.

In a further advantageous embodiment, the voltage sensor is applied at the line side of the pole part.

In a further very advantageous embodiment, the metal grid has an at least partly cylindrical form, or a C- or L-shaped form.

This form could get better accuracy in the resulting measurement. The width of the metal grid plays very important role, normally it should be no less than the width of the capacitive electrode.

According to a method of producing such an embedded pole part, the invention is, that the current sensor, capacitive sensor electrode and corresponding shielded cable, which connects the current transformer and the capacitive electrode, are molded in insulating resin as first step, and then the metal grid is assembled to the molded subassembly and then electrically connected to the shielded cable in a final step.

It is of advantage that the production is divided into different steps in order to guarantee the functionality of the final products.

Figure 1:
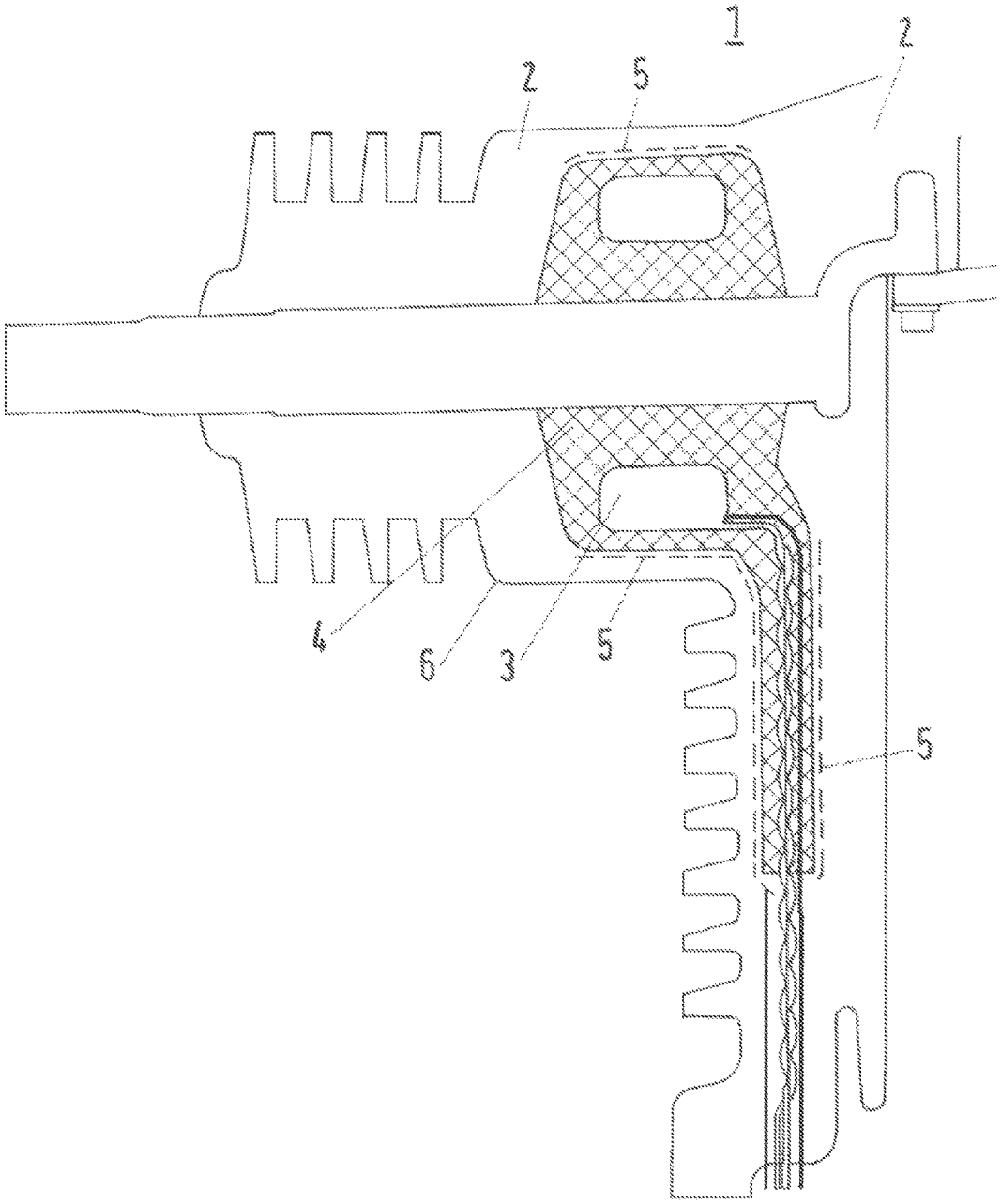
FIG. 1 an embodiment of the invention.

In FIG. 1 displays an embodiment of the invention.

A current transformer CT is arranged around the conductor of a pole part, the external surface of this current transformer is used as capacitance sensor which results effectively in a voltage sensor 3. So the current transformer, capacitive voltage sensor and the conductor are embedded in an insulation resin, which is the effective voltage sensor housing 4 as first production step. This allows to check the current and voltage sensor properties separately.

Afterwards a metal grid 5 is assembled around the produced subassembly, and that metal grid is connected to ground potential through the shielding of the signal cable as described above.

In production process, the current sensor, capacitive sensor electrode and corresponding shielded cable which connects to the CT and the capacitive electrode are molded in insulating resin as first step. The advantage is that this component could be functionally checked before embedding in the complete pole part 1. Then the metal grid is assembled to the molded subassembly and then electrically connected to the shielded cable. As a independent component, this is embedded together with the vacuum interrupter within the final molding process.

So parasitic capacitance, which occur between capacitance voltage sensor and external surface of insulation resin, is limited and controlled by this grounded conducting grid, that means the changing surface condition will not influence the internal voltage sensor measurement capacitance. So it is prevented, that such capacities can have bad influence on the sensing accuracy of the voltage sensor.

This is realized by the invention.

This can be also applied into the line side of the embedded pole part.

FIG. 2 shows again the virtual capacitances, like already described above, and makes clear how the invention works.

Figure 3:
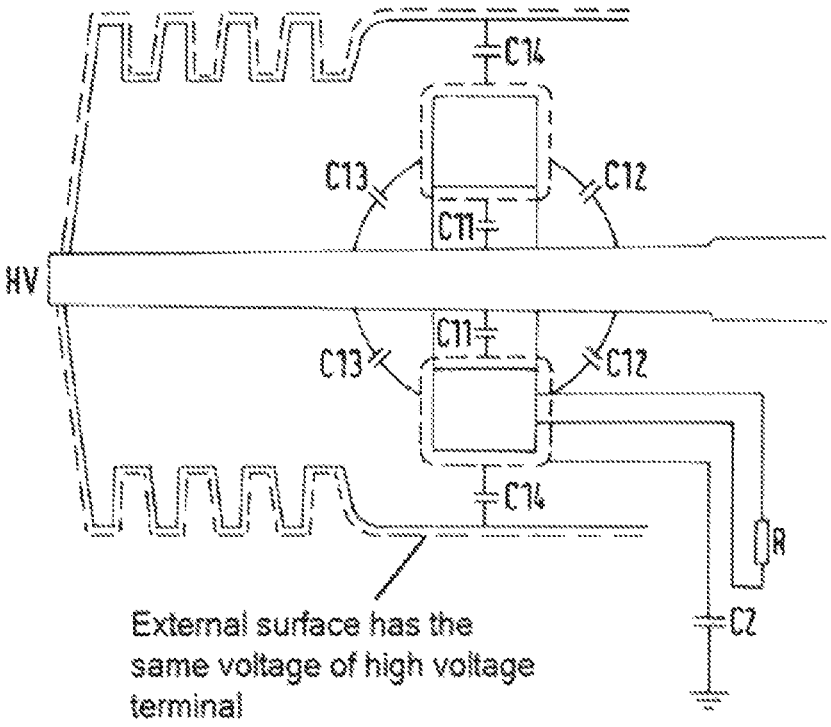
FIG. 3 an example from the prior art with all disturbing capacitances in a worst case situation.

FIG. 3 displays the state of the art, as already mentioned above, with all disturbing capacitances in worst case situation, the external surface of insulation resin became conducting due to some reasons, the value of C14 will increase a lot.

Figure 4:
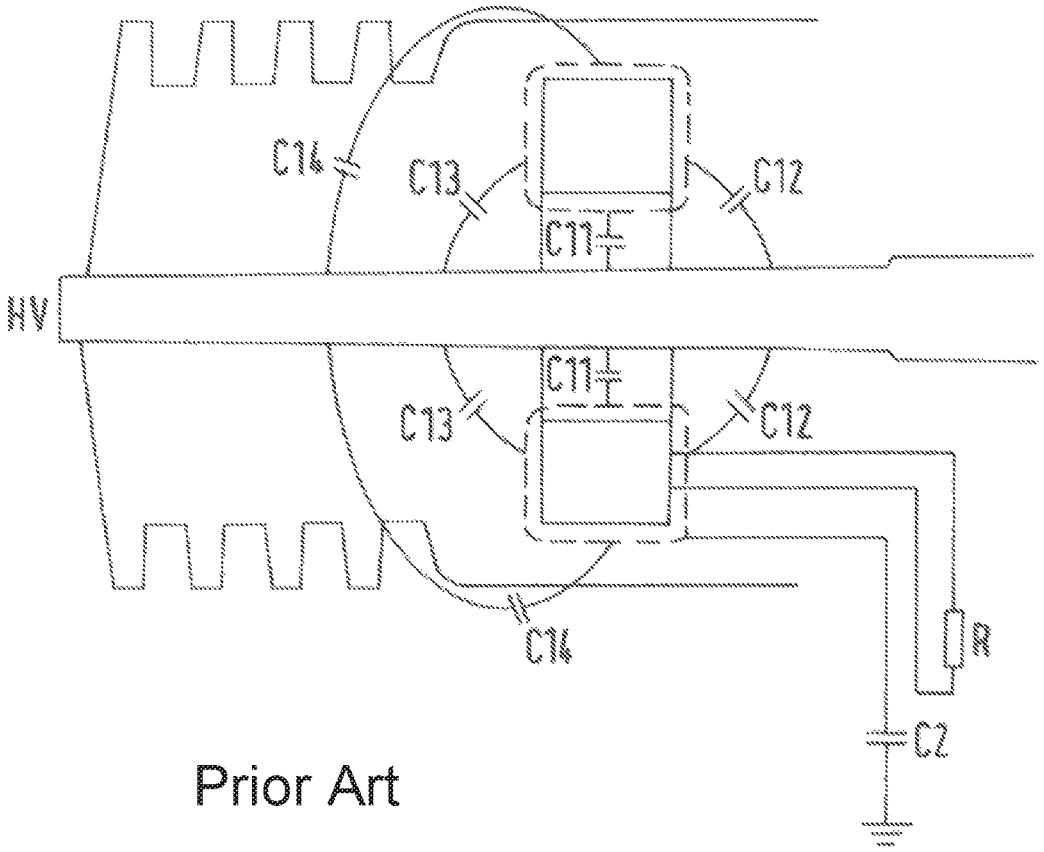
FIG. 4 a device of the prior art without a metal grid.

FIG. 4 also shows the state of the art without metal grid, the C14 value is small as compare to FIG. 3.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

POSITION NUMBERS

1 embedded pole part
2 insulating resin
3 voltage sensor
4 voltage sensor housing
5 metal grid
6 outer surface of the insulating resin

The invention claimed is:

1. An embedded pole part for medium or high voltage use, the part comprising:

a vacuum interrupter which is embedded into an insulating resin;

a current and/or voltage sensor including a sensor housing, integrated inside the insulating resin, arranged rotationally symmetrically around a conductor of the pole part, the sensor housing having an outer circumference;

a metal grid, implemented into the insulating resin and around the outer circumference of the sensor housing.

2. The part of claim 1, comprising the current sensor.

3. The part of claim 1, comprising the voltage sensor.

4. The part of claim 1, comprising the current sensor and the voltage sensor.

5. The part of claim 1, wherein the metal grid is electrically conductive or capacitively connected to ground potential.

6. The part of claim 5, wherein the metal grid is connected to ground potential via an electrical conductive cable, wherein the conductive cable is aligned along its path from the metal grid to the ground potential around one or more signal cables of the current and/or the voltage sensor in a spiral way.

7. The part of claim 1, wherein the metal grid is connected to ground potential via an electrical conductive cable, wherein the conductive cable is aligned along its path from the metal grid to the ground potential around one or more signal cables of the current and/or the voltage sensor in a spiral way.

8. The part of claim 1, comprising the voltage sensor, wherein the voltage sensor is applied at a line side of the pole part.

9. The part of claim 1, wherein, in order to achieve good function, the metal grid has an at least partly cylindrical form, or a C- or L-shaped form.

10. The part of claim 1, wherein the metal grid has an at least partly cylindrical form.

11. The part of claim 1, wherein the metal grid has a C-shaped form.

12. The part of claim 1, wherein the metal grid has an L-shaped form.

13. A method for producing the part of claim 1, the method comprising:

molding the current sensor, capacitive sensor electrode, and a corresponding shielded cable, which connects the current transformer and the capacitive electrode, in the insulating resin; and then assembling a metal grid to a molded subassembly; and then electrically connecting the metal grid to the corresponding shielded cable.

14. An embedded pole part for medium or high voltage use, the part comprising:

a vacuum interrupter which is embedded into an insulating resin;

a current and/or voltage sensor, and including a sensor housing having an outer circumference, integrated inside the insulating resin; and a metal grid, surrounding the outer circumference and implemented into the insulating resin, wherein the metal grid is arranged between the sensor housing of the current and/or voltage sensor and an outer surface of the insulating resin, wherein the metal grid is connected to ground potential via an electrical conductive cable, and wherein the conductive cable is aligned along its path from the metal grid to the ground potential around one or more signal cables of the current and/or the voltage sensor in a spiral way.

15. The part of claim 14, wherein the metal grid has an at least partly cylindrical form.

16. The part of claim 14, wherein the metal grid has a C-shaped form.

17. The part of claim 14, wherein the metal grid has an L-shaped form.

18. An embedded pole part for medium or high voltage use, the part comprising:

a vacuum interrupter which is embedded into an insulating resin;

a current and/or voltage sensor including a sensor housing having an outer circumference, integrated inside the insulating resin; and a metal grid, implemented into the insulating resin, arranged around the circumference of the sensor housing, wherein the metal grid is arranged between the sensor housing of the current and/or voltage sensor and an outer surface of the insulating resin, and wherein a conductive cable is aligned along its path from the metal grid to the ground potential around one or more signal cables of the current and/or the voltage sensor in a spiral way.

19. The part of claim 18, wherein the metal grid has an at least partly cylindrical, C-shaped, or L-shaped form.

* * * * *